US005097084A

United States Patent [19]

Milani et al.

[11] Patent Number: 5,097,084

[45] Date of Patent: Mar. 17, 1992

[54] COMPOSITIONS OF HYDROCARBONS FROM REFINING, ENDOWED WITH IMPROVED FLUIDITY AT LOW TEMPERATURES

[75] Inventors: Federico Milani, St. Maria Maddalena; Ettore Santoro, Paderno Dugnano; Luciano Canova, Novara; Enrico Albizzati, Novara; Paolo Falchi, Chieti, all of Italy

[73] Assignees: Societa' Italiana Additivi Per Carburanti S.r.l.; Ausimont S.r.l., both of Pescara, Italy

[21] Appl. No.: 376,562

[22] Filed: Jul. 7, 1989

[30] Foreign Application Priority Data

Jul. 8, 1988 [IT] Italy ..... 21281 A/88

[51] Int. Cl.[5] ..... C10L 1/16

[52] U.S. Cl. ..... 585/12; 585/13; 585/18; 44/459; 252/43

[58] Field of Search ..... 585/12, 18, 13; 44/459; 252/43

[56] References Cited

U.S. PATENT DOCUMENTS

| | | | |
|---|---|---|---|
| 3,374,073 | 3/1968 | Gergel et al. | 44/62 |
| 3,388,977 | 6/1968 | Burkard et al. | 44/62 |
| 3,443,917 | 5/1969 | Le Suer | 44/62 |
| 3,522,180 | 7/1970 | Sweeney et al. | 585/12 |
| 3,524,732 | 8/1970 | Sweeney et al. | 44/62 |
| 3,640,691 | 2/1972 | Ilnyckyj et al. | 44/62 |
| 3,679,380 | 7/1972 | Biswell et al. | 585/12 |
| 3,681,302 | 8/1972 | Sweeney et al. | 585/12 |
| 3,697,429 | 10/1972 | Engel et al. | 585/12 |

FOREIGN PATENT DOCUMENTS

| | | |
|---|---|---|
| 0060090 | 9/1982 | European Pat. Off. . |
| 060609 | 9/1982 | European Pat. Off. . |
| 202550 | 11/1986 | European Pat. Off. . |

OTHER PUBLICATIONS

Chemical Abstracts, vol. 100, No. 8, Feb. 1984, p. 162, Abstract No. 54343r.

*Primary Examiner*—Anthony McFarlane
*Assistant Examiner*—Nhat Phan
*Attorney, Agent, or Firm*—Morgan & Finnegan

[57] ABSTRACT

The fluidity at low temperatures of compositions based on liquid hydrocarbons from refining is improved by the addition, preferably in solution, of ethylene/-propylene/(conjugated diene) copolymers or terpolymers, containing 20–55% of propylene, optionally degraded by thermo-oxidation, and structurally characterized by values of at least one of $X_2$ and $X_4$ parameters, which are equal to, or lower than, about 0.02, indicative of the absence in the polymeric chain of propylene linking inversions.

11 Claims, 2 Drawing Sheets

COMPOSITIONS OF HYDROCARBONS FROM REFINING, ENDOWED WITH IMPROVED FLUIDITY AT LOW TEMPERATURES

FIELD OF THE INVENTION

The present invention is concerned with compositions based on liquid hydrocarbons from refining, such as, e.g., gas oils and fuel oils in general, and from a more general standpoint, the products known as the "middle distillates" which, with decreasing temperature, show undesired alterations in their physical properties, which can be detected, e.g. by means of measurements of the following parameters: the cloud point (C.P.), the pour point (P.P.) and the cold filter plugging point (C.F.P.P.), as respectively defined in ASTM D2500-81, ASTM D97-66, and IP 309/83 standards.

For example, the gas oils used for automobile, naval and aeronautical internal combustion engine feeding or for heat generation purposes, are known to become less fluid with decreasing temperature, causing serious drawbacks in their use.

BACKGROUND OF THE INVENTION

Such a phenomenon is mainly due to the precipitation of n-paraffins contained in the gas oil.

Obviating such a drawback by adding to the above said hydrocarbons suitable substances, generally of the polymeric type, is known as well.

The additives commonly used for such a purpose are represented by ethylene-vinyl acetate copolymers having suitable molecular weight values and compositions, or, according to Italian patents Nos. 811,873 and 866,519, by ethylene-propylene-(non-conjugated) diene copolymers or terpolymers, prepared with homogeneous-phase catalysts (based on vanadium compounds, and organometallic aluminum compounds).

In U.S. Pat. Nos. 3,374,073 and 3,756,954, as such additives ethylene-propylene-conjugated or non-conjugated diene terpolymers are proposed, which are prepared with homogeneous-phase catalysts, and are subsequently degraded by thermo-oxidation until suitable values of molecular weight are reached.

SUMMARY OF THE INVENTION

According to the present invention, it has now been discovered that certain particular ethylene-propylene copolymers, or terpolymers of such monomers with a conjugated diene, are endowed with exceptionally favorable characteristics as additives for improving the physical behavior, as measured by means of C.P., P.P. and C.F.P.P. values, of the above-mentioned hydrocarbons, particularly at low temperatures.

DETAILED DESCRIPTION OF THE INVENTION

Figure 1:
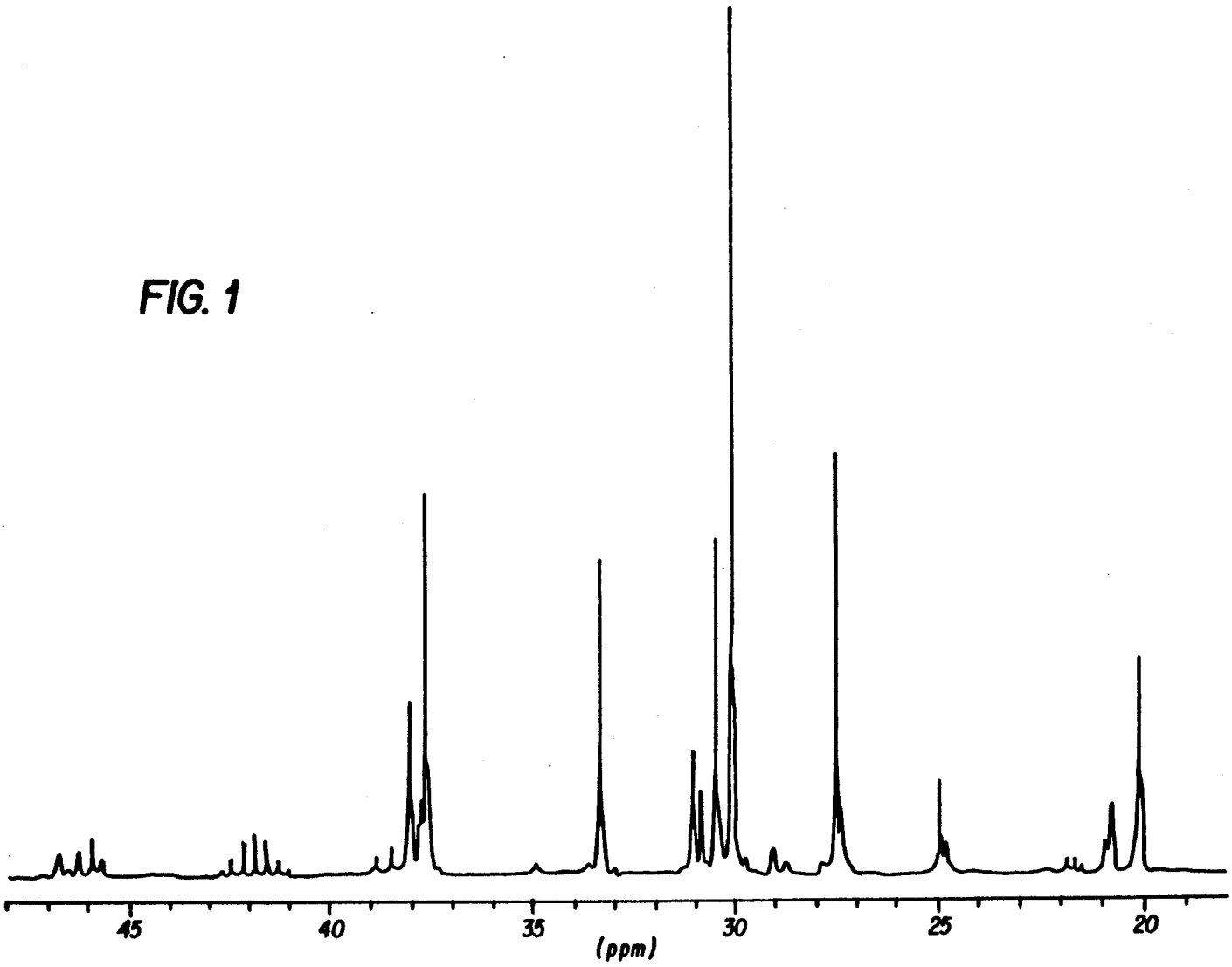
FIGS. 1 and 2 are $^{13}$C-NMR spectrums of copolymers.

The copolymers or terpolymers used additives according to the present invention are structurally characterized by the substantial absence in their polymeric chain of inversions in propylene linking pattern (also known as propylene "head-head", "tail-tail" inversions).

It is known in this regard that propylene may enter into the polymeric chain with insertions of either primary or secondary type, such as disclosed, e.g., by I. Pasquon and U. Giannini in "Catalysis Science and Technology" vol. 6, pages 65–159, J. R. Anderson & M. Boudart Eds., Springer Verlag, Berlin 1984.

By "inversion in propylene linking pattern", is meant the change in insertion modality (from primary to secondary) which the molecule of propylene may show in the macromolecule.

Methods for determining the distribution of ethylene-propylene sequences, and in particular the absence of the above inversion, in ethylene-propylene copolymers, are well known from the technical literature. They comprise well-defined procedures for qualitative and quantitative investigations, based on $^{13}$C Nuclear Magnetic Resonance, as disclosed, e.g., by J. C. Randall in "Polymer Sequence Determination by C-13-NMR Method" (Academic Press, N.Y. 1977) and in "Macromolecules", 11, 33 (1978); or by H. N. Cheng in "Macromolecules", 17, 1950 (1984); or by C. J. Charman et al. in "Macromolecules", 10, 536 (1977). Such procedures may be transferred as well to ethylene/propylene/diene terpolymers, in which the diene termonomer is present in relatively low amounts, generally lower than 10% by weight.

Ethylene-propylene copolymers and ethylene-propylene-conjugated diene terpolymers, in whose macromolecules propylene linking inversions are essentially absent, are characterized by very low values of absorption in $^{13}$C-NMR spectrum (obtained in solution in ortho-cloro-benzene at the temperature of 120° C., by using dimethyl-sulphoxide (DMSO) as the external reference) at about 34.9; 35.7 and 27.9 p.p.m. (chemical shift, referred to tetramethyl-silane (TMS)=0), typical of the presence of sequences of

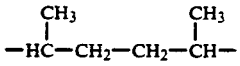

type (head-head or tail-tail inversion of $X_2$ type); and of

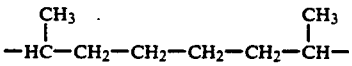

type (head-head or tail-tail inversion of $X_4$ type).

The substantial absence of propylene linking inversions in such copolymers and terpolymers is expressed by the fact that at least one of the $X_2$ and $X_4$ parameters, and preferably both of them, have values equal to, or smaller than, about 0.02.

It is known that $X_2$ and $X_4$ parameters represent the fraction of methylene sequences containing uninterrupted sequences of respectively 2 and 4 methylene groups between two successive methyl or methine groups in the polymeric chain, as computed relative to the total of the uninterrupted sequences of methylene groups, as determined by means of $^{13}$C-NMR. The value of such a fraction is computed according to the method described by J. C. Randall in "Macromolecules" 11, 33 (1978).

It was also found that from among the copolymers and terpolymers endowed with such a feature, those containing from 20 to 55%, and preferably from 25 to 45%, by weight of propylene, and from 0 to 10%, and preferably from 1 to 7%, by weight of monomeric units deriving from a conjugated diolefin, are advantageously used as additives.

Such copolymers and terpolymers may be used in amounts within the range from 0.005 to 0.25%, and preferably from 0.01% to 0.15%, by weight relative to their mixtures with the hydrocarbon, and may be added to the liquid hydrocarbons from refining preferably as solutions in suitable solvents constituted by hydrocarbons, and/or their blends, having an aromatic, paraffinic, or naphthenic character, and so forth, such as, e.g., those known on the market under the trade name Solvesso 100, 150, 200, HAN, Shellsol R, AB, E, A, and so forth, Exsold, Isopar, and so forth.

Therefore, a principal object of the present invention are liquid hydrocarbons from refining, comprising from 0.005% to 0.25% by weight, relative to the mixture of such hydrocarbons, of a copolymer of ethylene with propylene, or of a terpolymer of ethylene with propylene and a conjugated diolefin, characterized in that they contain from 20 to 55% by weight of propylene, and from 0 to 10% by weight of monomeric units derived form such a diolefin, and by values of at least one of said $X_2$ and $X_4$ parameters, as above defined, equal to, or lower than, about 0.02.

The copolymers and terpolymers suitable for use as additives according to the present invention are preferably obtained by copolymerization of the monomers carried out in the presence of catalysts, based on titanium compounds supported on a magnesium halide, and of organometallic compounds of aluminum. Such catalysts are disclosed, e.g., in U.S. Pat. No. 4,013,823; in published European patent application No. 202,550; in Italian patent No. 1,173,240; and in Italian patent applications No. 20,203 A/81 and No. 20,386 A/85.

As the conjugated diolefin suitable for forming the terpolymers to be used as the additives according to the present invention, the following are herein cited: butadiene, isoprene, piperylene, 1,3-hexadiene, 1,3-octadiene, 2,4-decadiene and cyclopentadiene. Butadiene is the preferred diolefin.

The copolymers and terpolymers preferred for use as additives according to the present invention have a viscosimetric molecular weight (Mv) within the range from 1,000 to 200,000, and preferably within the range from 3,000 to 150,000.

According to a further preferred aspect of the present invention, the above copolymers and terpolymers are subjected to thermo-oxidative degradation before being used as additives.

Such a degradation can be carried out according to per se known techniques, e.g., by heating the polymer under an atmosphere consisting of an oxygen-containing gas, at temperatures of at least 100° C., and up to 400° C., and preferably within the range from 300° to 350° C., for a long enough time for the (viscosimetric) molecular weight to be reduced down to a value within the range from 1000 to a value 5% lower than the original molecular weight value. The so-oxidized polymer has a content of C=O groups within the range from 0 to 10 per each 1,000 carbon atoms, as determined by I.R.-spectroscopy.

The degradation of the polymer may be advantageously—and indeed preferably—carried out inside extruders, or similar devices, with the possible addition of degrading substances such as peroxides, or polymer-modifying substances such as, e.g., amines. The degradation of the polymer may also be carried out in solution by procedures well known in the art.

The copolymers or terpolymers containing at least one, and preferably both, $X_2$ and $X_4$ parameters equal to, or lower than about 0.02, are particularly suitable for improving the physical behavior at low temperatures of the liquid hydrocarbons from refining, and obtained by distillation at a temperature within the range from about 120° C. to about 400° C., and which have a cloud point (C.P.) within the range of from +10° C. to −30° C., and a C.F.P.P. within the range from +10° C. to −25° C.

The compositions according to the present invention may also contain other types of generally mixed additives, such as anti-oxidant agents, basic detergents, corrosion inhibitors, rust inhibitors, pour-point depressants. The copolymers and terpolymers used according to the present invention are generally compatible with these additives.

Such additives may be directly added to the compositions, or they may be present in the polymeric solution which is added to the hydrocarbon coming from refining.

EXAMPLES

The following examples are given in order still better to illustrate the present invention, but without limiting its scope.

In these examples, the P.P. is measured according to the ASTM D97-66 standard; the C.P. is measured according to the ASTM D2500-81 Standard; and the C.F.P.P. is measured according to the IP 309/83 Standard.

EXAMPLE 1

An ethylene/propylene copolymer which contains 28% by weight of propylene is prepared by using a heterogeneous-phase catalyst based on $TiCl_4$ supported on $MgCl_2$, and tri-isobutylaluminum, as disclosed in Italian patent application No. 20,203 A/81, having a viscosimetric molecular weight of 100,000, and characterized by values of $X_2$ and $X_4$ parameters equal to 0.01.

Different amounts of such a solution were added in solution to a like number of samples of a gas oil having the following characteristics:

| | |
|---|---|
| Initial boiling temperature | = 179° C. |
| Boiling temperature at 5% by volume | = 215° C. |
| Boiling temperature at 50% by volume | = 278° C. |
| Boiling temperature at 95% by volume | = 374° C. |
| End boiling temperature | = 385° C. |
| Specific gravity at 15° C. | = 0.8466 g/cc |
| P.P. | = −6° C. |
| C.P. | = +1° C. |
| C.F.P.P. | = +2° C. |

In Table 1 below, the amounts of copolymer contained in gas oil compositions and the values of P.P., C.P. and C.F.P.P. of the so-formulated compositions are reported.

EXAMPLE 2 (COMPARATIVE EXAMPLE)

An ethylene-propylene copolymer containing 28% by weight of propylene is used. This was prepared by means of a homogeneous-phase catalytic system based on $VOCl_3$ and $Al_2(C_2H_5)_3Cl_3$, as disclosed in Example 1 of Italian patent No. 866,519, and had a viscosimetric molecular weight of 120,000. This copolymer was characterized by values of $X_2$ and $X_4$ parameters of 0.05.

In Table 1, the values of P.P., C.P. and C.F.P.P. of the same gas oil that as of Example 1 after the addition of different amounts of such copolymers, added in solution, are reported.

EXAMPLE 3

By following the same procedure, and using the same catalytic system as in Example 1, an ethylene/propylene copolymer was prepared which contained 38% by weight of propylene, and had a viscosimetric molecular weight of 100,000.

On $^{13}$C-NMR analysis, the values of $X_2$ and $X_4$ of such a copolymer turned out respectively to be 0.02 and 0.005.

The $^{13}$C-NMR spectrum of the copolymer is attached hereto as FIG. 1. Such a spectrum was determined in orthodichlorobenzene at 120° C. (chemical shift relative to TMS).

In Table 1, the characteristics of the gas oil disclosed in Example 1 are reported after the addition of different amounts of such copolymer, added in solution.

EXAMPLE 4 (COMPARATIVE EXAMPLE)

By the same catalyst and process as in (comparative) Example 2, an ethylene/propylene copolymer was prepared which contained 38.5% by weight of propylene, and had a viscosimetric molecular weight of 120,000.

On $^{13}$C-NMR analysis, the values of $X_2$ and $X_4$ parameters of such a polymer turned out respectively to be 0.13 and 0.006.

Figure 2:
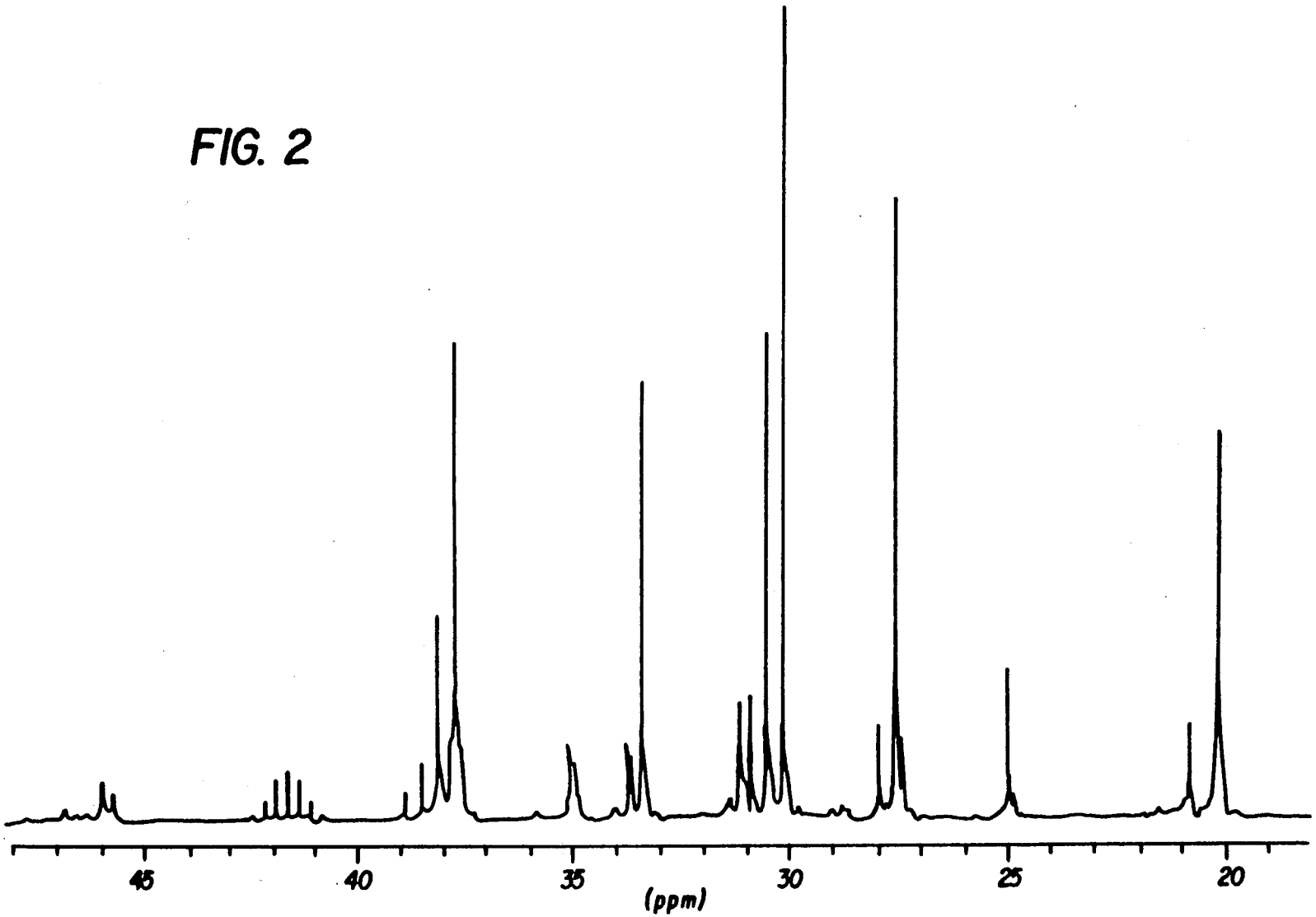

The $^{13}$C-NMR spectrum of the copolymer is attached hereto as FIG. 2. Such spectrum was determined in orthodichlorobenzene at 120° C. (chemical shift relative to TMS).

In Table 1, the characteristics of the gas oil of Example 1 are reported after the addition of different amounts of such a copolymer, added in solution.

EXAMPLE 5

By using the same catalytic system and process as in Example 1, an ethylene/propylene/butadiene terpolymer was prepared which contained 36% by weight of propylene and 6% by weight of butadiene, and had a viscosimetric molecular weight of 100,000.

On $^{13}$C-NMR analysis, the values of $X_2$ and $X_4$ parameters of such a polymer turned out respectively to be 0.02 and 0.01.

In Table 1, the characteristic of the gas oil of Example 1 are reported after the addition of such a copolymer, added in solution.

EXAMPLE 6

The terpolymer prepared in Example 5 was degraded by being subjected to heating in air at a temperature of 320° C. for about 1 minute, inside a twin-screw Werner-Pfleiderer extruder, having a diameter of 33 mm and a ratio of length to diameter of 33. The so-obtained polymer had a viscosimetric molecular weight of 44,000, and a content of C=O groups of 0.15 per each 1,000 carbon atoms, as determined by I.R. spectrophotometry.

In Table 1, the characteristics of the gas oil of Example 1 are reported after the addition of such a copolymer, added in solution.

EXAMPLE 7

Using the same catalytic system and process as in Example 5, an ethylene/propylene/butadiene terpolymer was prepared which contained 28.5% by weight of propylene and 3.5% of butadiene, and had a viscosimetric molecular weight of 80,000.

The $^{13}$C-NMR analysis showed that such terpolymer had values of $X_2$ and $X_4$ parameters respectively of 0.02 and 0.005.

By following the same procedure as in Example 6, such terpolymer was degraded until a molecular weight of 20,500 and a content of C=O groups of 0.2 per each 1,000 carbon atoms were reached.

In Table 1, the characteristics are reported which were measured on the gas oil of Example 1 after the addition of such a copolymer, added in solution.

EXAMPLE 8

Different amounts of the non-degraded polymer disclosed in Example 7 were added to a gas oil having the following characteristics:

| | |
|---|---|
| Initial boiling temperature | = 198° C. |
| Boiling temperature at 5% by volume | = 237° C. |
| Boiling temperature at 50% by volume | = 292° C. |
| Boiling temperature at 95% by volume | = 363° C. |
| End boiling temperature | = 371° C. |
| Specific gravity at 15° C. | = 0.8495 g/cc |
| P.P. | = −9° C. |
| C.P. | = −2° C. |
| C.F.P.P. | = −4° C. |

In Table 1 the characteristics of the so-formulated gas oil, with the additive having been added in solution, are reported.

EXAMPLE 9

The degraded terpolymer prepared according to Example 7 was used as an additive for the gas oil described in Example 8.

The data relevant to the so-obtained composition are reported in Table 1.

TABLE 1

| Example | P.P. values (°C.) Added polymer* (ppm) | | | | C.P. values (°C.) Added polymer* (ppm) | | | | C.F.P.P. values (°C.) Added polymer* (ppm) | | | |
|---|---|---|---|---|---|---|---|---|---|---|---|---|
| No. | 0 | 175 | 350 | 700 | 0 | 175 | 350 | 700 | 0 | 175 | 350 | 700 |
| 1 | −6 | −23 | −26 | −33 | +1 | +1 | +1 | +1 | +2 | −4 | −7 | −10 |
| 2 | −6 | −11 | −15 | −21 | +1 | +1 | +1 | +1 | +2 | −1 | −3 | −4 |
| 3 | −6 | −26 | −32 | −42 | +1 | +1 | +1 | +1 | +2 | −4 | −7 | −10 |
| 4 | −6 | −10 | −15 | −15 | +1 | +1 | +1 | +1 | +2 | +1 | −1 | −4 |
| 5 | −6 | −24 | −33 | −42 | +1 | +1 | +1 | +1 | +2 | −3 | −6 | −8 |
| 6 | −6 | −25 | −32 | −44 | +1 | +1 | +1 | +1 | +2 | −3 | −9 | −11 |
| 7 | −6 | −22 | −30 | −42 | +1 | +1 | +1 | +1 | +2 | −7 | −11 | −13 |
| 8 | −9 | −18 | −24 | −30 | −2 | −2 | −2 | −2 | −3 | −5 | −9 | −11 |
| 9 | −9 | −18 | −21 | −27 | −2 | −2 | −2 | −2 | −3 | −7 | −9 | −13 |

*The polymer was added in solution at 10% by weight in SOLVESSO 150.

What is claimed is:

1. A composition of liquid hydrocarbons from refining, comprising a copolymer of ethylene with propylene, or a terpolymer of ethylene with propylene and a conjugated diolefin, said copolymer or terpolymer used in an amount from 0.005% to 0.25% by weight relative to their hydrocarbon mixture, said copolymer or terpolymer containing from 20 to 55% by weight of propylene, from 0 to 10% by weight of monomeric units derived from said diolefin, and at least one of the $X_2$ and $X_4$ parameters of said copolymer and terpolymer is equal to, or lower than, about 0.02 where $X_2$ and $X_4$ parameters represent the fraction of methylene sequences containing uninterrupted sequences of respectively 2 and 4 methylene groups between two successive methyl or methine groups in the polymeric chain, as computed relative to the total of the uninterrupted sequences of methylene groups, as determined by $^{13}$C-MR.

2. Composition according to claim 1, wherein both $X_2$ and $X_4$ parameters of said copolymer or terpolymer are equal to, or lower than, about 0.02.

3. Composition according to claim 1 or 2, wherein the conjugated diolefin is butadiene.

4. Composition according to claim 1 or 2, wherein said copolymer or terpolymer is prepared by copolymerization of the monomers in the presence of catalysts based on titanium compounds supported on magnesium halides and on organometallic aluminum compounds.

5. Composition according to claim 1 or 2, wherein said terpolymer has a conjugated diolefin content within the range from 1 to 7% by weight.

6. Composition according to claim 1 or 2, wherein said copolymer or terpolymer has a viscosimetric molecular weight within the range from 1,000 to 200,000.

7. Composition according to claim 1 or 2, wherein said copolymer or tepolymer has a viscosimetric molecular weight within the range from 3,000 to 150,000.

8. Composition according to claim 1 or 2, wherein said copolymer or terpolymer is degraded at temperatures of at least 100° C., and have a content of C=O groups within the range from 0 to 10 per each 1,000 carbon atoms.

9. Composition according to claim 8, wherein the degradation of the copolymer or terpolymer is carried out at a temperature within the range from 300° to 350° C.

10. Composition according to claims 1 or 2, wherein the copolymer or terpolymer is added in solution.

11. Composition according to claim 10, wherein said solvent of the solution is constituted by hydrocarbons, and/or their blends, of aromatic, paraffinic or naphthenic character.

* * * * *